US007328491B1

(12) United States Patent
Walsh

(10) Patent No.: US 7,328,491 B1
(45) Date of Patent: Feb. 12, 2008

(54) GATE MATE

(76) Inventor: Lawrence M. Walsh, 405 Deming St., Rochester, NY (US) 14606

( * ) Notice: Subject to any disclaimer, the term of this patent is extended or adjusted under 35 U.S.C. 154(b) by 169 days.

(21) Appl. No.: 11/122,440

(22) Filed: May 5, 2005

(51) Int. Cl.
*B25B 27/14* (2006.01)
*E05D 15/06* (2006.01)
*E05D 15/16* (2006.01)

(52) U.S. Cl. ..... 29/281.5; 29/281.6; 29/467; 49/404

(58) Field of Classification Search ..... 29/281.5, 29/467, 281.6; 49/404, 426, 292
See application file for complete search history.

(56) References Cited

U.S. PATENT DOCUMENTS

| | | | | | |
|---|---|---|---|---|---|
| 1,698,087 | A | | 1/1929 | Field | |
| 2,402,693 | A | | 6/1946 | Summerbell | |
| 2,950,132 | A | | 8/1960 | Kocsuta | |
| 3,368,286 | A | * | 2/1968 | Zenke | 33/518 |
| 3,888,477 | A | * | 6/1975 | Tate | 269/82 |
| 3,938,619 | A | | 2/1976 | Kurabayashi | |
| 3,946,569 | A | | 3/1976 | Stuber | |
| 3,955,800 | A | | 5/1976 | Russo | |
| 4,045,003 | A | | 8/1977 | McCluskey et al. | |
| 4,151,779 | A | | 5/1979 | Timmer | |
| 4,242,775 | A | | 1/1981 | Eickmann | |
| 4,485,539 | A | * | 12/1984 | Blaine | 29/91.1 |
| 4,582,300 | A | | 4/1986 | Chappell | |
| 4,583,278 | A | * | 4/1986 | Flores et al. | 29/467 |
| 4,752,060 | A | | 6/1988 | McCluskey et al. | |
| 4,818,166 | A | | 4/1989 | Szukay | |
| 5,054,952 | A | | 10/1991 | Chara | |
| D332,381 | S | * | 1/1993 | Rotellini, Jr. | D8/71 |
| 5,272,838 | A | * | 12/1993 | Gibbs | 49/404 |
| 5,362,030 | A | | 11/1994 | Iler, Jr. | |
| 5,429,396 | A | | 7/1995 | Guest | |
| 5,444,951 | A | | 8/1995 | Scott | |
| 5,649,347 | A | * | 7/1997 | Cattadoris | 29/252 |
| 5,713,561 | A | | 2/1998 | Sugiyama | |
| 5,791,034 | A | * | 8/1998 | Verret | 29/281.5 |
| 5,836,572 | A | | 11/1998 | Sugiyama | |
| 5,837,014 | A | * | 11/1998 | Williams | 29/401.1 |
| 6,347,445 | B2 | * | 2/2002 | Long, Jr. | 29/402.08 |
| 6,413,168 | B1 | * | 7/2002 | McKendry et al. | 473/239 |
| 6,575,100 | B2 | * | 6/2003 | Faucher et al. | 104/126 |
| 6,843,468 | B2 | | 1/2005 | Marshall | |
| 6,843,612 | B2 | | 1/2005 | Engel | |
| 6,948,277 | B2 | * | 9/2005 | Parrish | 47/70 |

* cited by examiner

*Primary Examiner*—Joseph J. Hail, III
*Assistant Examiner*—Alvin J Grant
(74) *Attorney, Agent, or Firm*—Hiscock & Barclay, LLP

(57) ABSTRACT

This specification discloses an apparatus for constructing a gate opening comprised of a spacing unit with a first end and a second end, means for expanding the spacing unit such that the distance between the first end and the second end may vary; means for locking the spacing unit such that the distance between the first end and the second end remains constant. The first end is comprised of means for attaching the first end to fence stock; and the second end is comprised of means for attaching the second end to fence stock. In some embodiments, the means for attaching the spacing unit to fence stock is comprised of dual-purpose notches.

19 Claims, 20 Drawing Sheets

13
100
102

GATE MATE

FIELD OF THE INVENTION

This invention relates generally to an apparatus to promote the construction of a gate opening and specifically to an expandable brace configured to hold two fence stocks in position such that a gate may later be properly attached between the fence stocks.

BACKGROUND OF THE INVENTION

The swinging gates found on fences are often difficult to properly construct. The gate must be mounted to fence stock such that the gate may swing freely. To aid in achieving this objective, it is desirable to ensure that the fence stocks to which the gate is attached are substantially parallel.

Current gate construction involves simply digging a hole and placing the fence stock within the hole. The stock may be buried within the hole by filling the cavity with a setting agent, such as dirt or wet cement. Upon drying, the fence stock is relatively stable. For information related to fence and gate construction, reference may be had to U.S. Pat. Nos. 5,713,561 to Sugiyama (Outdoor Structure Such as Gate Post Gate Wing or Fence and Method for Constructing This); 5,836,572 to Sugiyama (Method for Constructing an Outdoor Structure Such as a Gate Post, Gate Wing, or Fence); 5,272,838 to Gibbs (Gate Conversion Kit); 5,362,030 to Iler (Fence Post Module); 4,582,300 to Chappell (Fence Support Structure); 5,444,951 to Scott (Bracket for Supporting Fence Posts); 3,955,800 to Russo (Railing Structure); and the like. The content of each of the aforementioned patents is hereby incorporated by reference into this specification.

This technique is deficient in that the fence stock often shifts position as the cement hardens. When soil is used to fill the cavity, the loosely packed soil does not hold the stock in position and shifting likewise occurs. Reference may be had to U.S. Pat. Nos. 4,045,003 to McCluskey (Support Devices for Stanchions); 4,752,060 to McCluskey (Support Devices for Stanchions); 3,946,569 to Stuber (Method and Means for Installing a Post); and the like. The content of each of the aforementioned patents is hereby incorporated by reference into this specification. It would be desirable to construct a device that will prevent such shifting and hold the fence stock in the desired position. Such a device ensures the fence stock remains substantially parallel both before and after setting. It is an object of this invention to provide such a device.

SUMMARY OF THE INVENTION

In accordance with the present invention, there is provided a device for positioning fence stock comprised of a spacing unit, means for expanding the spacing unit, means for locking the spacing unit such that it does not expand, and means for attaching the spacing unit to fence stock.

The apparatus described above is advantageous because it allows for more efficient gate construction than current methods.

BRIEF DESCRIPTION OF THE DRAWINGS

The invention will be described by reference to the following drawings, in which like numerals refer to like elements, and in which.

Figure 1:
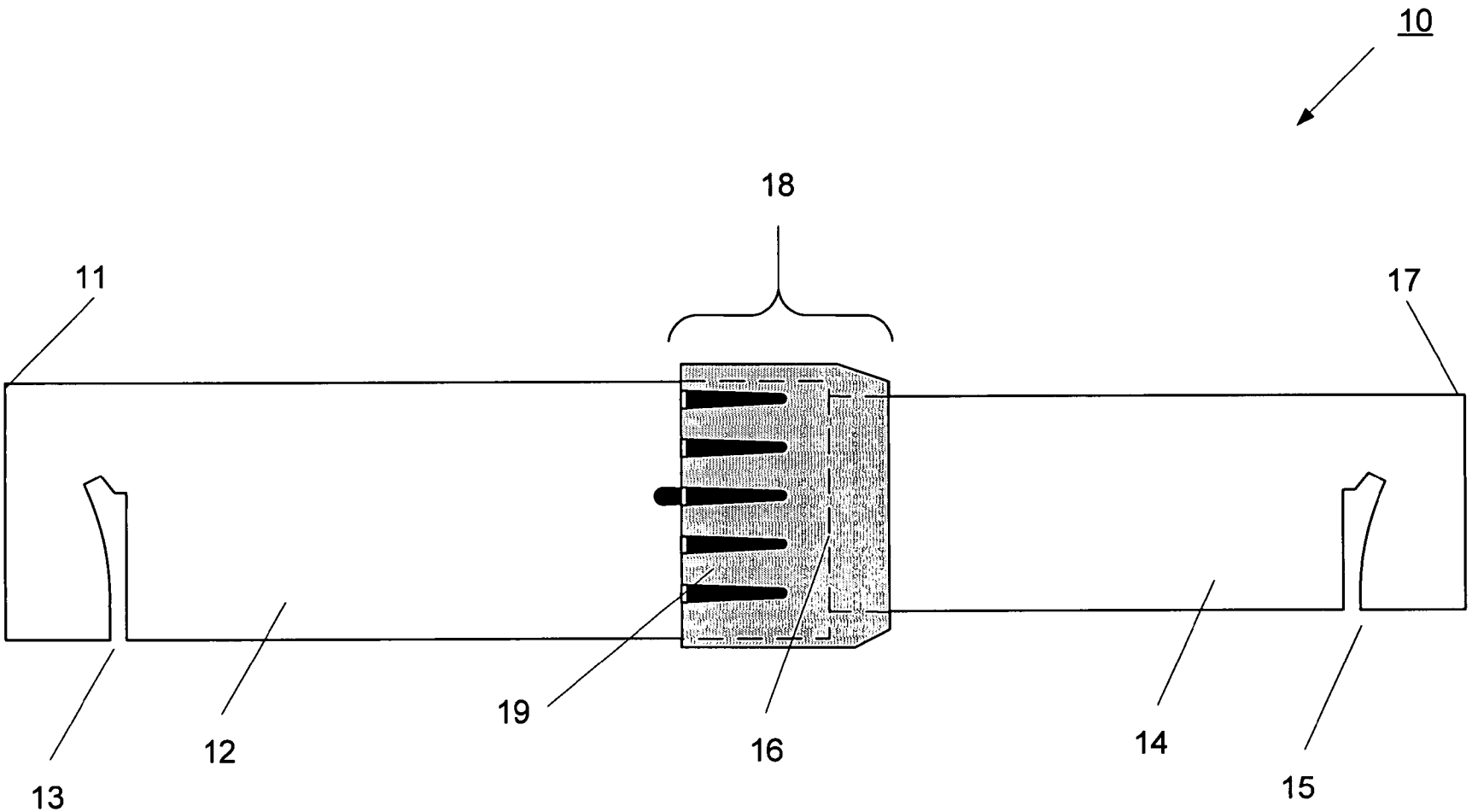
FIG. 1 is a schematic view of one embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a schematic view of one embodiment of the invention. In FIG. 1, spacing unit 10 is comprised of a first end 11 and a second end 17. In the embodiment depicted, spacing unit 10 is comprised of a first spacing unit 12 and a second spacing unit 14. Spacing unit 10 is further comprised of means for expanding 16 the spacing unit 10 such that the distance between first end 11 and second end 17 may vary. In the embodiment depicted, means for expanding 16 is achieved by sliding the second spacing unit 14 within the first spacing unit 12. Other means for expanding may be found in U.S. Pat. Nos. 6,843,468 to Marshall (Handrail and Bracket Assembly); 3,938,619 to Kurabayashi (Stanchion); and the like. The content of each of the aforementioned patents is hereby incorporated by reference into this specification. In this manner, the distance between first end 11 and second end 17 is varied. In one embodiment, first spacing unit 12 is constructed from 1.25 inch pipe, such as, for example, PVC (polyvinylchloride) pipe. In such an embodiment, second spacing unit 14 is constructed from 1 inch pipe.

As shown in FIG. 1, first end 11 is further comprised of first notch 13 which, in the embodiment depicted, is a dual-purpose notch configured to receive both round and square fence stock. Second end 17 is likewise configured with dual-purpose notch 15. Spacing unit 10 is also comprised of means for locking 18. In the embodiment depicted, means for locking 18 is twist-grip lock 19.

Figure 2:
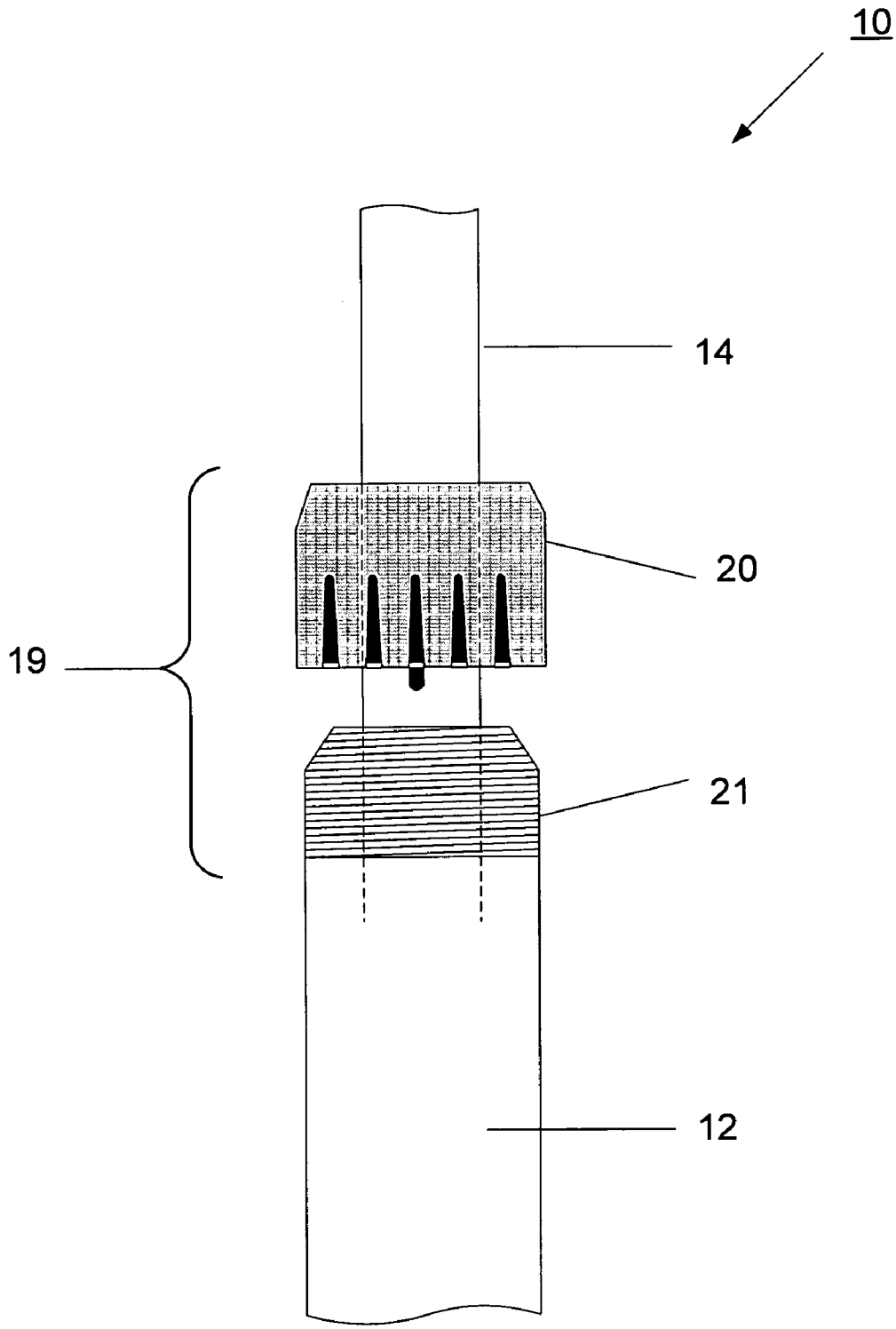
FIG. 2 is a schematic view of one locking mechanism of the present invention.

FIG. 2 is a partial view of spacing unit 10 which better illustrates the twist-grip lock 19 of FIG. 1. Similar locks are well known to those skilled in the art. Reference may be had to U.S. Pat. Nos. 6,843,612 to Engel (Retaining Ring Apparatus and Method); 5,429,396 to Guest (Snap-in Assemblies and Retaining Means Therefore); 5,054,952 to Chara (Device for detachably fastening and securing an insert in a sleeve); 4,818,166 to Szukay (Fastening a component on a shaft or in a bore against axial displacement); 4,242,775 to Eickmann (Snapring); 4,151,779 to Trimmer (Lock and Spacer Ring); 1,698,087 to Field (Coupling for Vacuum Cleaners); 2,402,693 to Summerbell (Threadless Retainer); 2,950,132 to Mocsuta (Threadless Pipe Coupling Having a Split Ring Locking Means); and the like. The content of each of the aforementioned patents is hereby incorporated by reference into this specification.

In the embodiment depicted in FIG. 2, twist-grip lock 19 is comprised of male end 21, which is attached to first spacing unit 12. Twist-grip lock 19 is further comprised of female end 20, which is attached to second spacing unit 14. As would be apparent to one skilled in the art, female end 20 is comprised of an o-ring (not shown) which expands when male end 21 and female end 20 are tightly bound together. This expansion locks first spacing unit 12 and second spacing unit 14 in position. When male end 21 and female end 20 are not tightly bound together, the o-ring (not shown) does not expand, and thus first spacing unit 12 and second spacing unit 14 may freely slide. Alternatively locking means are also within the scope of this invention.

Figure 3:
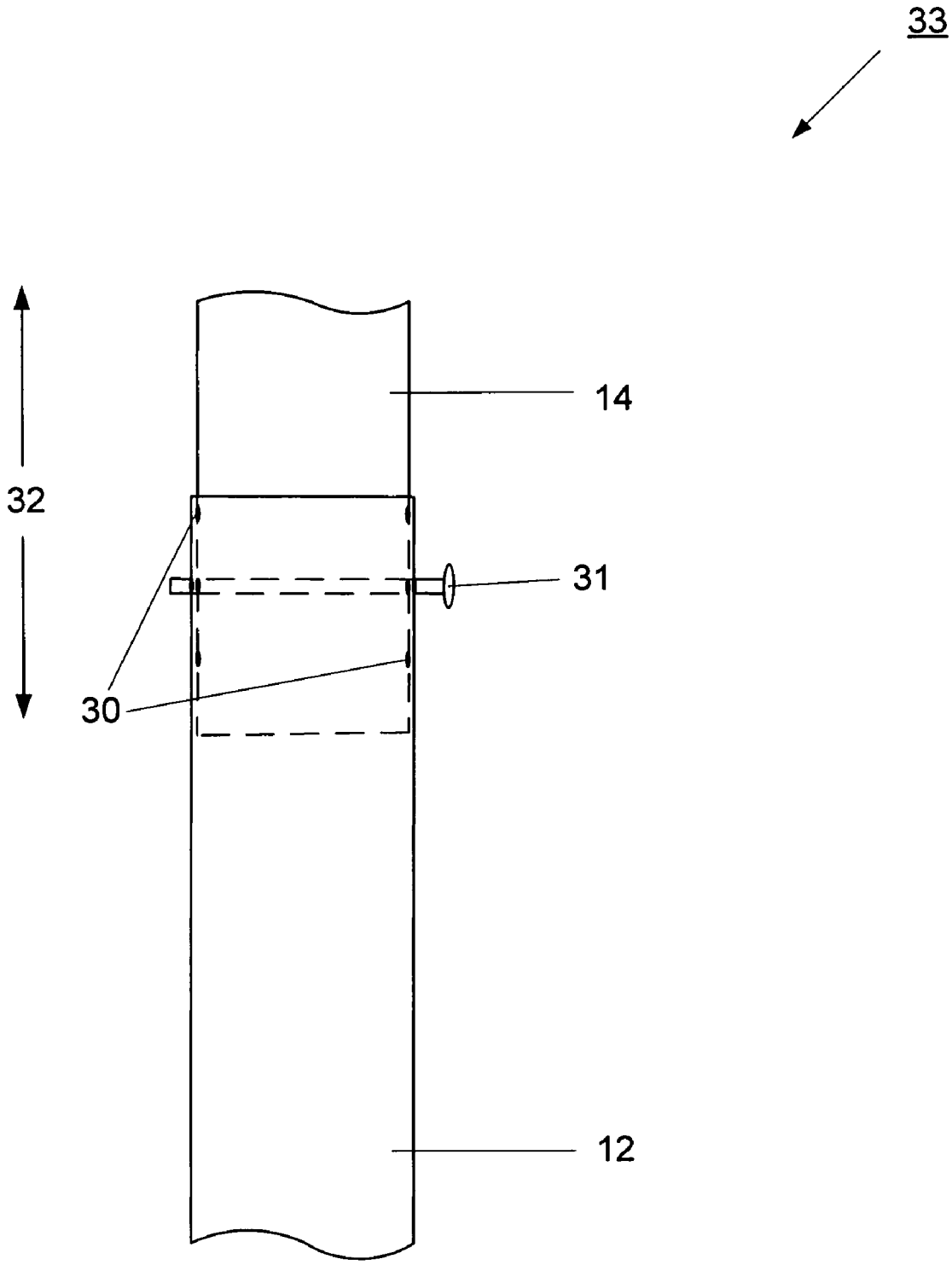
FIG. 3 is a schematic view of another locking mechanism of the present invention.

FIG. 3 is a depiction of another locking mechanism that falls within the scope of this invention. As illustrated in FIG. 3, spacing unit 33 is comprised of first spacing unit 12 and, disposed within first spacing unit 12, second spacing unit 14. First spacing unit 12 and second spacing unit 14 each possess holes 30 such that a hitch-pin 31 may be passed through holes 30, thus locking first spacing unit 12 and second spacing unit 14 in position. In the embodiment depicted, a simple pin 31 is used. As would be apparent to one skilled in the art, alternative structures could be used. For example, one may use a threaded screw, a screw and bolt, a flexible wire, or other means for preventing the movement of the first and second spacing unit in direction 32. In the embodiment depicted in FIG. 3, holes 30 are all drilled into the spacing units on the same side of the spacing unit. In another embodiment (not shown) the holes may be drilled on different sides of the spacing unit. In the embodiment depicted in FIG. 3 only one such locking mechanism is used. In another embodiment, two such locking mechanisms are used.

Figure 4:
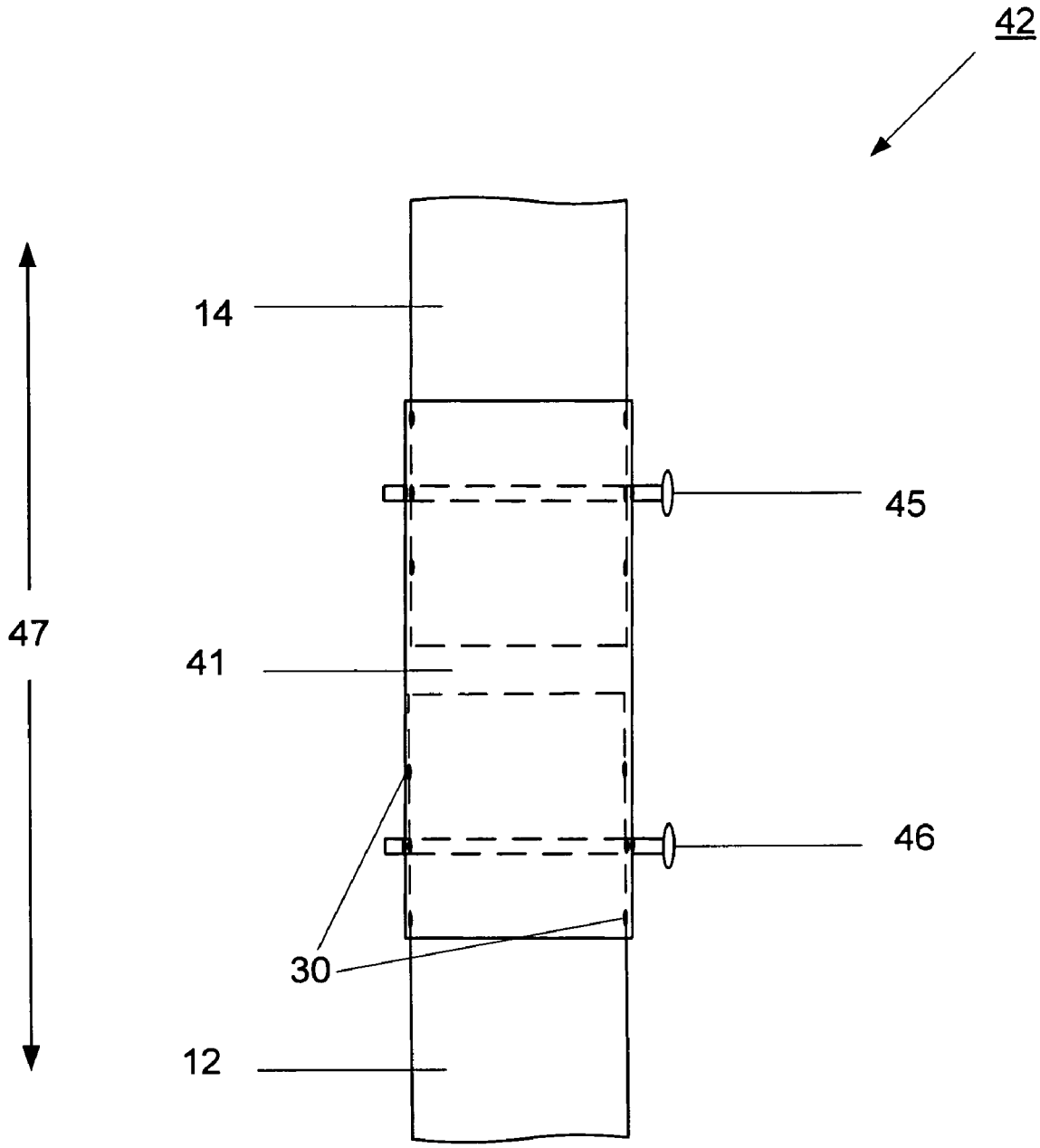
FIG. 4 is a schematic view of one means for expansion of the present invention.

FIG. 4 illustrates a pin-lock mechanism wherein two pins (45 and 46) are used. As illustrated in FIG. 4, spacing unit 42 is comprised of a first spacing unit 12, a second spacing unit 14, and a third spacing unit 41. In the embodiment depicted, spacing units 12 and 14 are disposed within spacing unit 41 and all three spacing units possess holes 30 which receive pins 46 and 46. When the pins are not engaged, first and second spacing units 12 and 14 may slide relative to third spacing unit 41 in the direction of arrow 47. When the pins are engaged, such movement is prevented. In this manner, the spacing unit 42 may be expanded to accommodate gate openings of various sizes.

Figure 5:
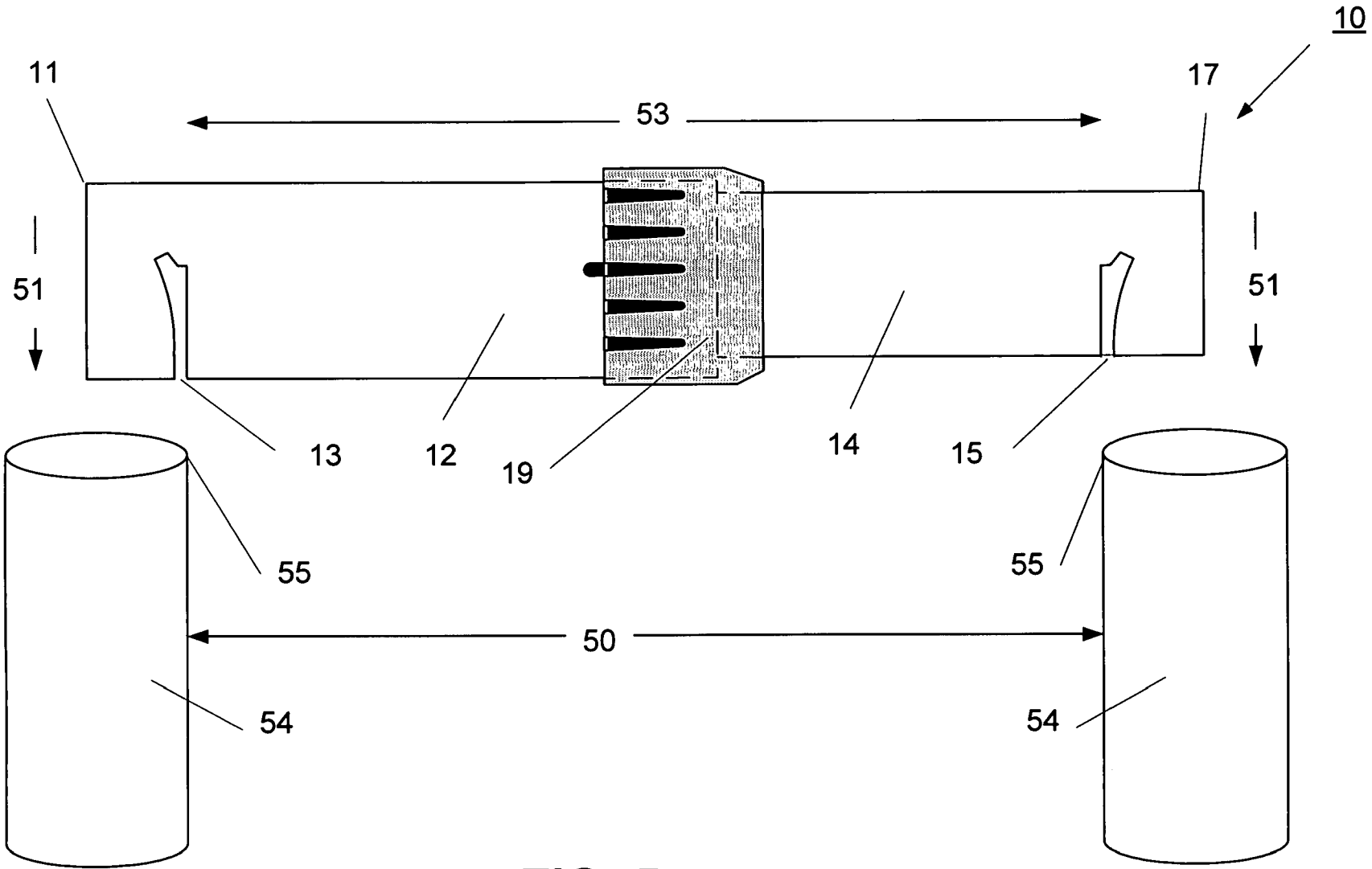
FIG. 5 is a schematic view of one embodiment of the invention as it attaches to round fence stock.
Figure 6:
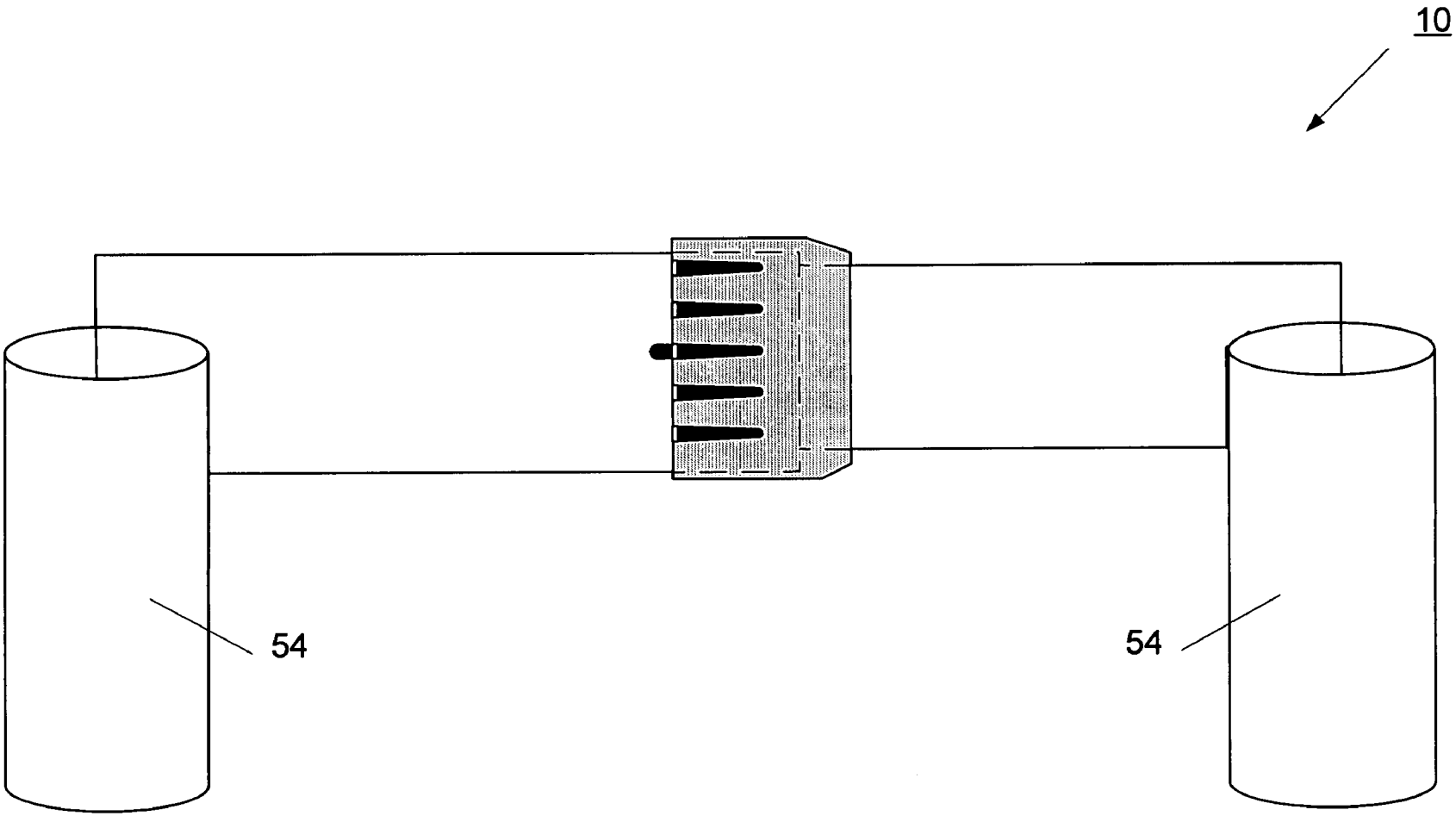
FIG. 6 is a schematic view of one embodiment of the invention after it has been attached to round fence stock.

For example, and with reference to FIG. 5, spacing unit 10 may be expanded until distance 53 is equal to the distance 50 between fencing stocks 54. Spacing unit 10 may be expanded until dual-purpose notches 13 and 15 align with fencing edges 55. Once the notches 13 and 15 are properly aligned, spacing unit 10 is moved in the direction of arrows 51. In this manner, spacing unit 10 may be attached to fencing stock 54. FIG. 6 is a depiction of apparatus 10 after the attachment is complete using dual-purpose notches 13 and 15. Apparatus 10 is operatively configured to expand such that the distance between notch 13 and 15 may vary. In one embodiment, the distance varies from about three feet, when the unit is collapsed, to about five feet and four inches, when the unit is totally extended. In another embodiment, the distance varies from about four feet, five and one half inches to about eight feet. In yet another embodiment, the distance varies from about six feet and seven and one half inches to about twelve feet.

Figures 7A, 7B, 7C:
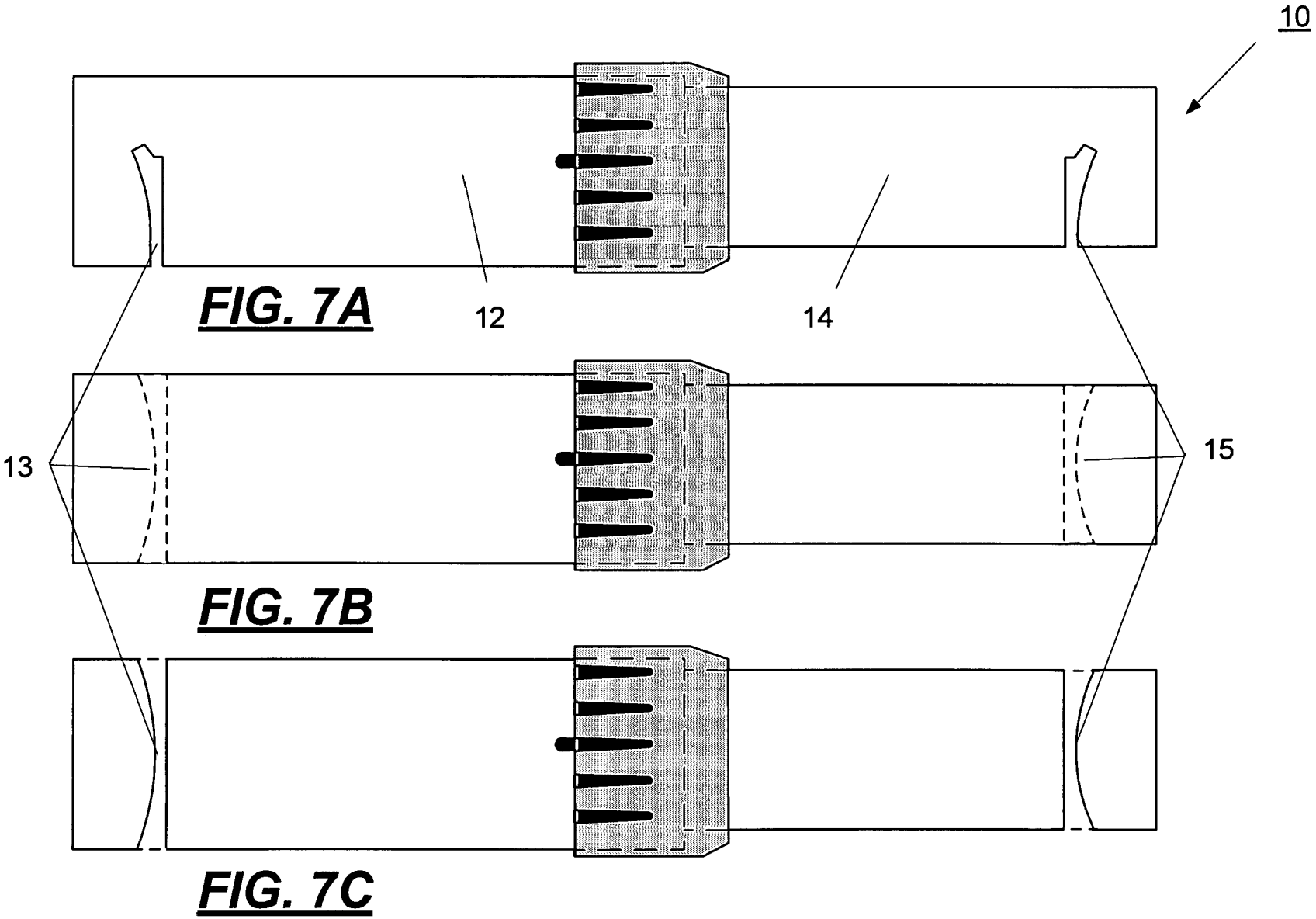
FIG. 7A is a side schematic view of one dual-purpose notch for attaching the invention to fence stock.
FIG. 7B is a top schematic view of the device and the dual-purpose notch shown in FIG. 5A.
FIG. 7C is a bottom schematic view of the device and the dual-purpose notch shown in FIG. 5A.
Figure 8A:
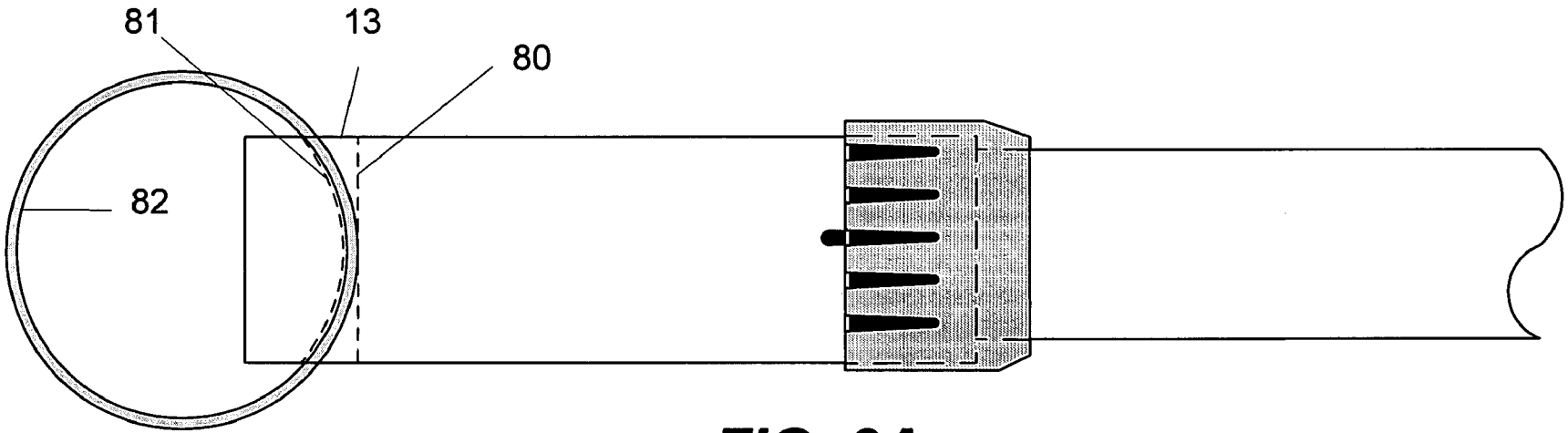
FIGS. 8A and 8B are top schematic views of two embodiments of the invention which are operatively configured to attached to round fence stock and square fence stock respectively.
Figure 8B:
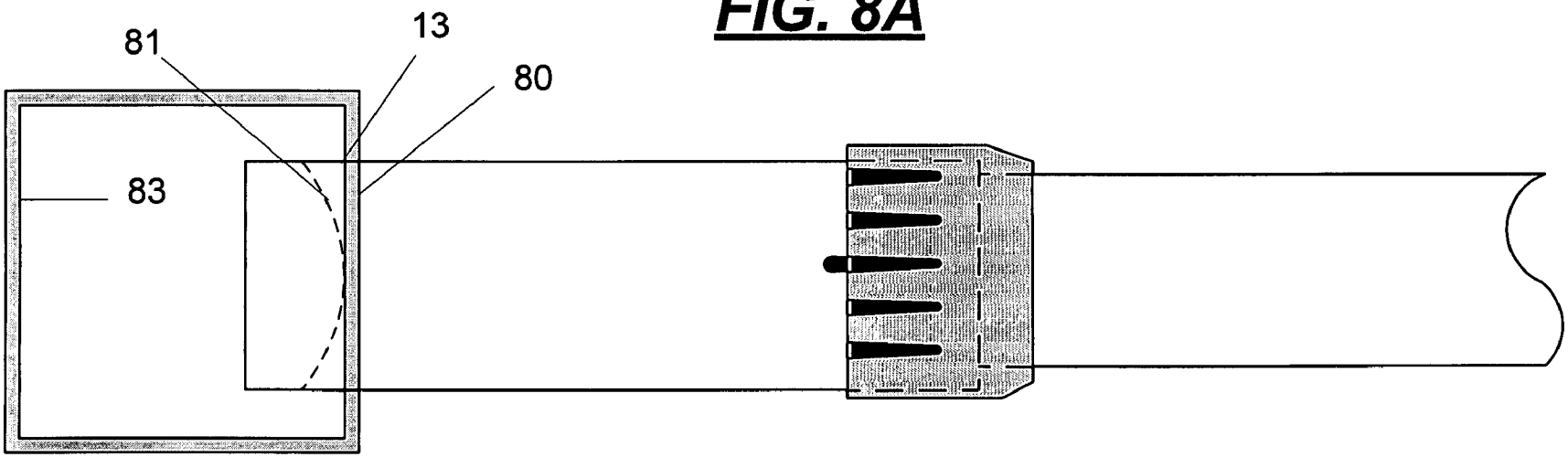

FIGS. 7A, 7B and 7C are depictions of apparatus 10, and specifically dual-purpose notches 13 and 15 from a side, top, and bottom perspective. As would be apparent to one skilled in the art, dual-purpose notches 13 and 15 are operatively configured to receive both round fence stock and square fence stock. FIGS. 8A and 8B provide an illustration of the device 10 and dual-purpose notch 13 after it has received a round fence stock (FIG. 8A) and a square fence stock (FIG. 8B). It is clear from FIGS. 8A and 8B that the dual-purpose notch is operatively configured to receive both round and square fence stock. In one embodiment, the aforementioned notches (13 and 15) are cut approximately half way through their respective spacing units (12 and 14). In another embodiment, notches 13 and 16 are approximately 6 mm wide, and thus accommodate fence stock.

In FIG. 8A, dual-purpose notch 13 has received round fence stock 82. It is clear from the illustration that dual-purpose notch 13 possess a straight edge 80 and a curved edge 81. As shown in FIG. 8A, the curved surface of round fence stock 82 aligns with the curved edge 81 of dual-purpose notch 13.

In FIG. 8B, dual-purpose notch 13 has received square fence stock 83. As illustrated in FIG. 8B, the straight surface of square fence stock 83 aligns with the straight edge 80 of dual-purpose notch 13. In this manner, dual-purpose notches 13 and 15 are configured to receive both square and round fence stock. In one such embodiment, notches 13 and 15 are of such a depth that the spacing unit 10 sits evenly upon the fence stock.

Figure 9:
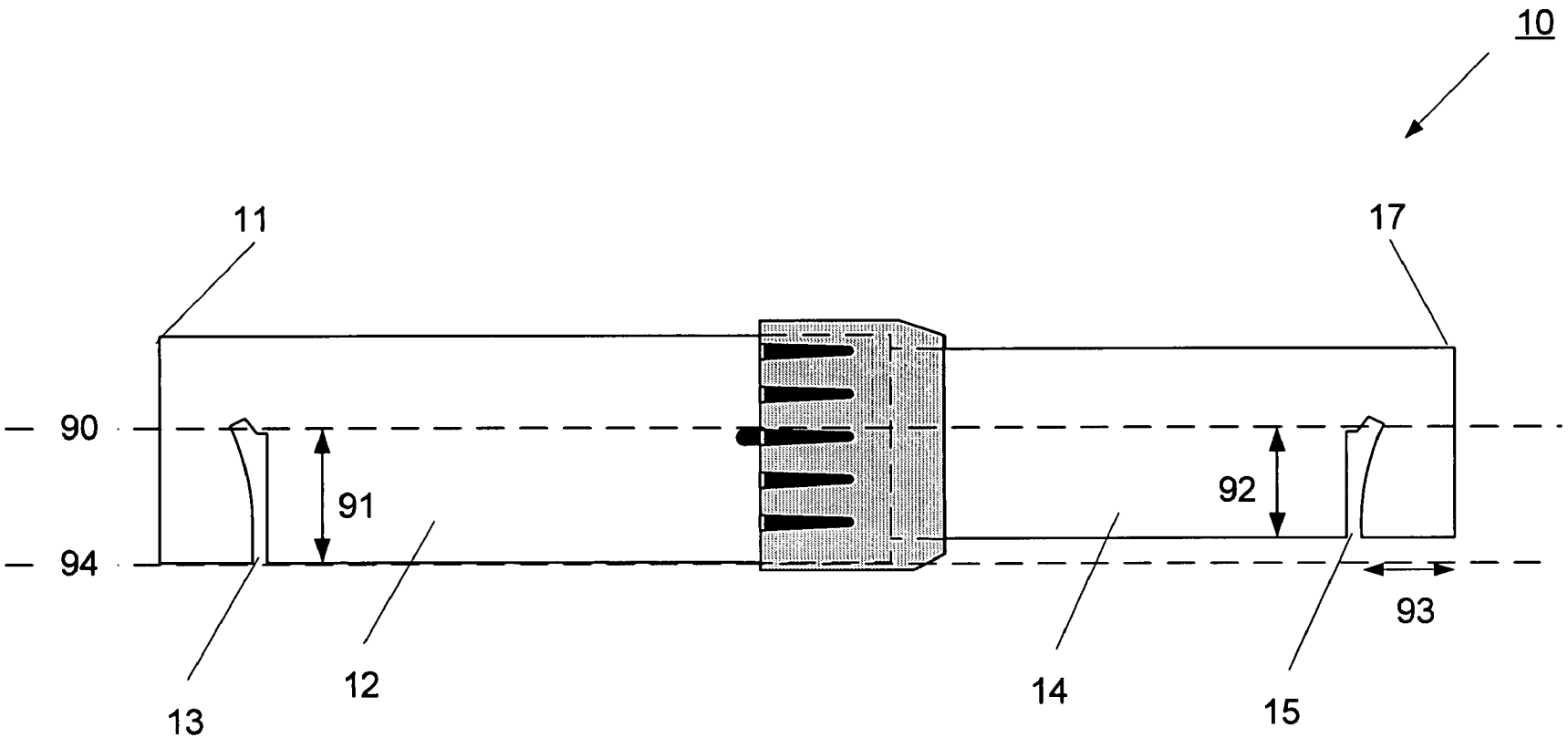
FIG. 9 is a schematic view of one embodiment of the invention which illustrates the positioning of the notches.

FIG. 9 shows spacing unit 10 which is comprised of notches 13 and 15. In the embodiment depicted, the notches 13 and 15 are positioned at a distance 93 from first end 11 and second end 17 respectively. In one embodiment, distance 93 is approximately one inch. In another embodiment, distance 93 is approximately 0.75 inches. In the embodiment depicted, notch 15 has a depth 92 while notch 13 has a depth 91. In one embodiment, the first spacing unit 12 is thicker than the second spacing unit 14, thus permitting the second spacing unit 14 to be disposed within the first spacing unit 12. In one such embodiment depth 91 is greater than depth 93. Notch 13 and notch 15 are of such a depth that line 90, which intersects the bottom of both notches is substantially parallel to line 94, which runs the length of spacing unit 10.

Figures 10A, 10B, 10C:
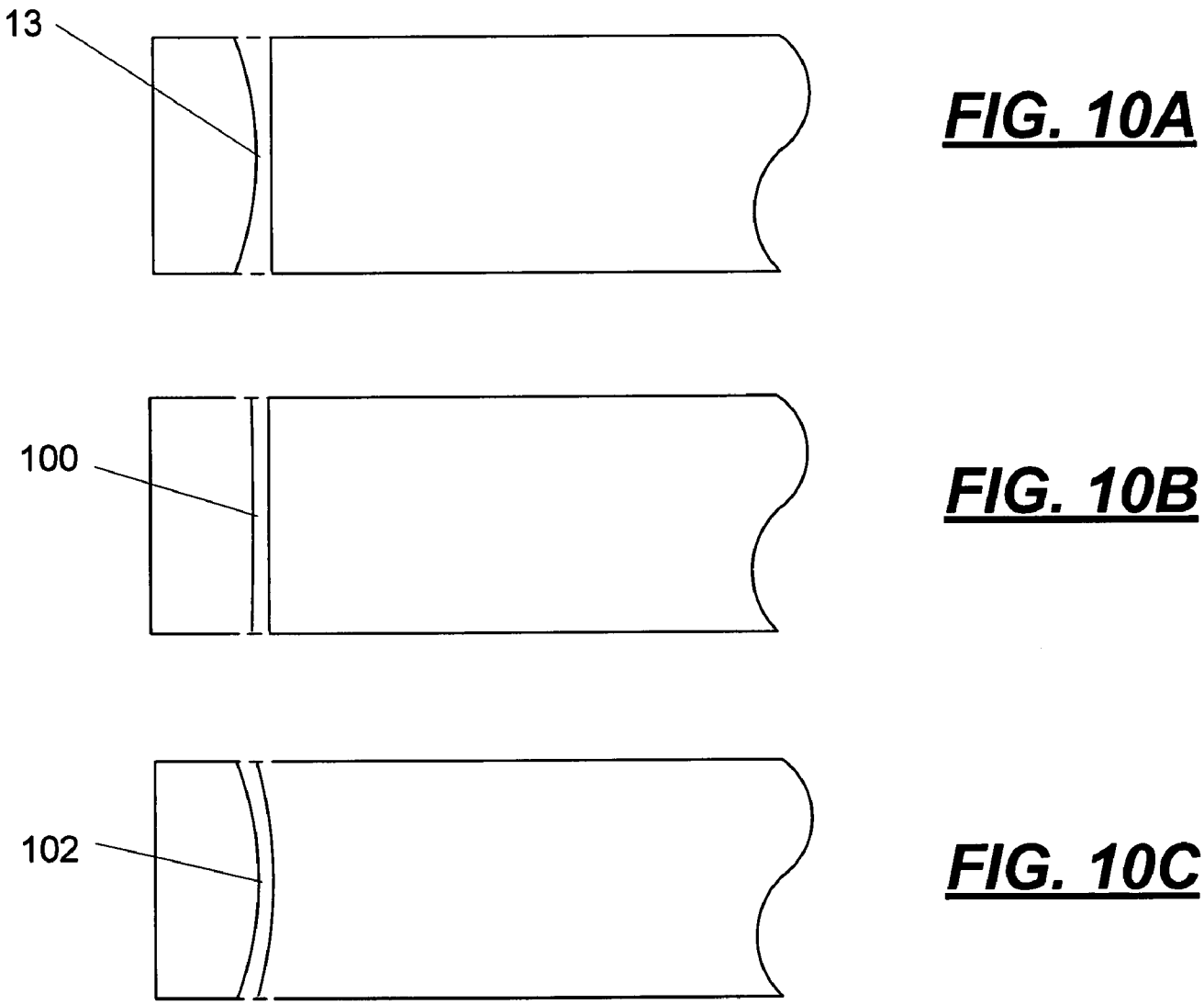
FIGS. 10A, 10B, and 10C are illustrations of three notches of the present invention.

FIG. 10 depicts alternative notch configurations. In FIG. 10A, dual-purpose notch 13 is illustrated. In FIG. 10B, notch 100 is shown. It is clear that notch 100 is operatively configured to receive square fence stock. In FIG. 10C, it is clear that notch 102 is operatively configured to receive round fence stock. As would be apparent to one skilled in the art, there are multiple ways to configure these notches to provide additional functionality to the device.

Figure 11A:
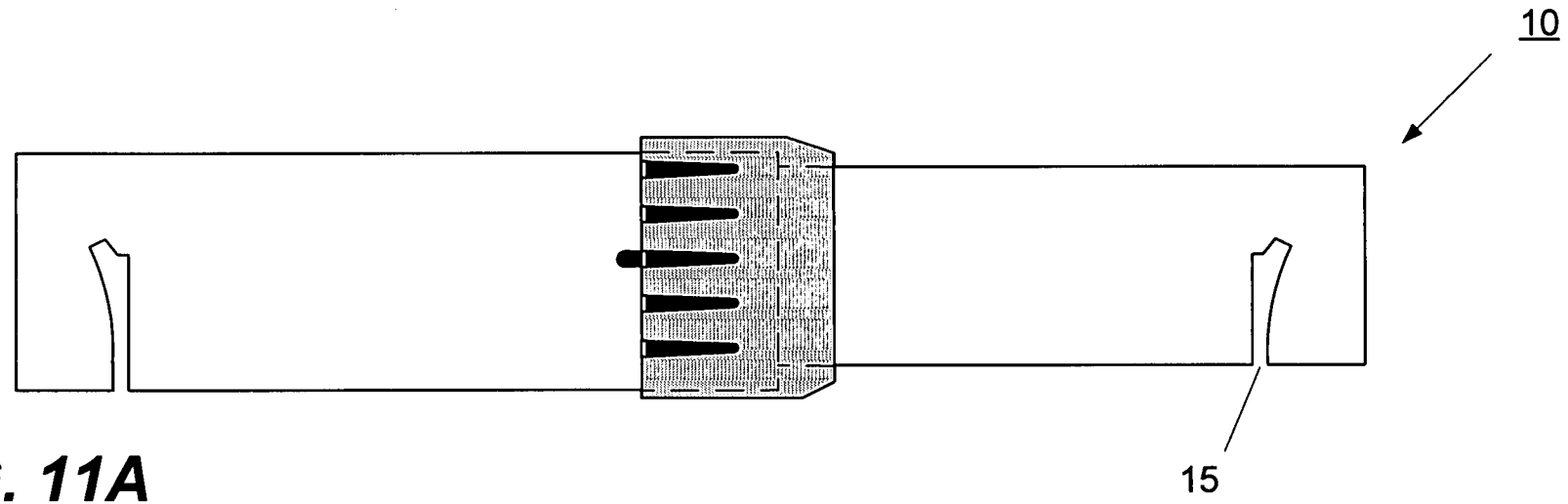
FIGS. 11A and 11B are schematic views of two notch configurations of the present invention.

FIG. 11A depicts a merging of square notch 100 and curved notch 102 to provide dual-purpose notch 13. In the embodiment depicted in FIG. 11B, the notches are not merged into a single, dual-purpose notch, but are divided into a total of four notches.

Figure 11B:
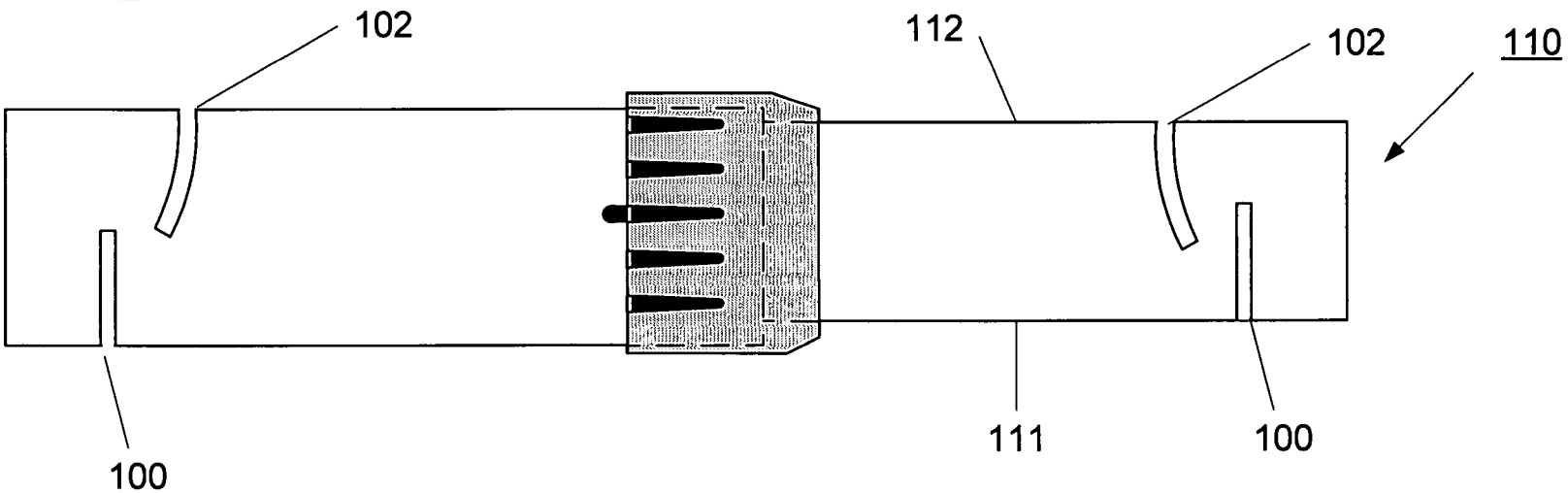

FIG. 11B shows a side view of spacing unit 110. Square notches 100 are disposed on first side 111. Curved notches 102 are disposed on second side 112. In the embodiment depicted in FIG. 11B, notes 102 and notes 112 are on opposite sides of spacing unit 10. Similar notch configurations are shown in FIGS. 11C and 11D.

Figures 11C, 11D:
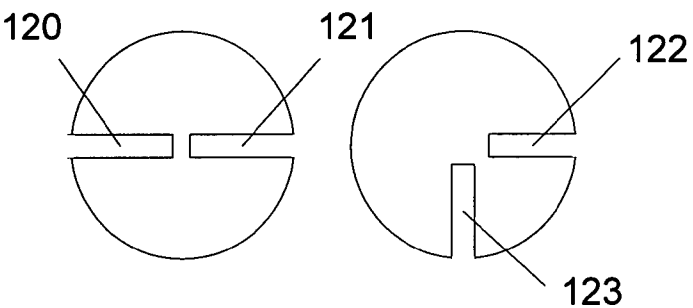
FIGS. 11C and 11D are end views of two notch configurations of the invention.

FIG. 11C is an end view of a similar notch configuration wherein notch 120 is disposed opposite notch 121. In the embodiment depicted in FIG. 11C, notch 122 is disposed at about a ninety degree angle from notch 123. As would be apparent to one skilled in the art, other angles are within the scope of this invention. In the embodiments depicted, notches 120, 121, 122, and 123 may be operatively configured to receive square fence stock, round fence stock, or the notches may be dual-purpose notches configured to receive both square and round fence stock.

Figure 12:
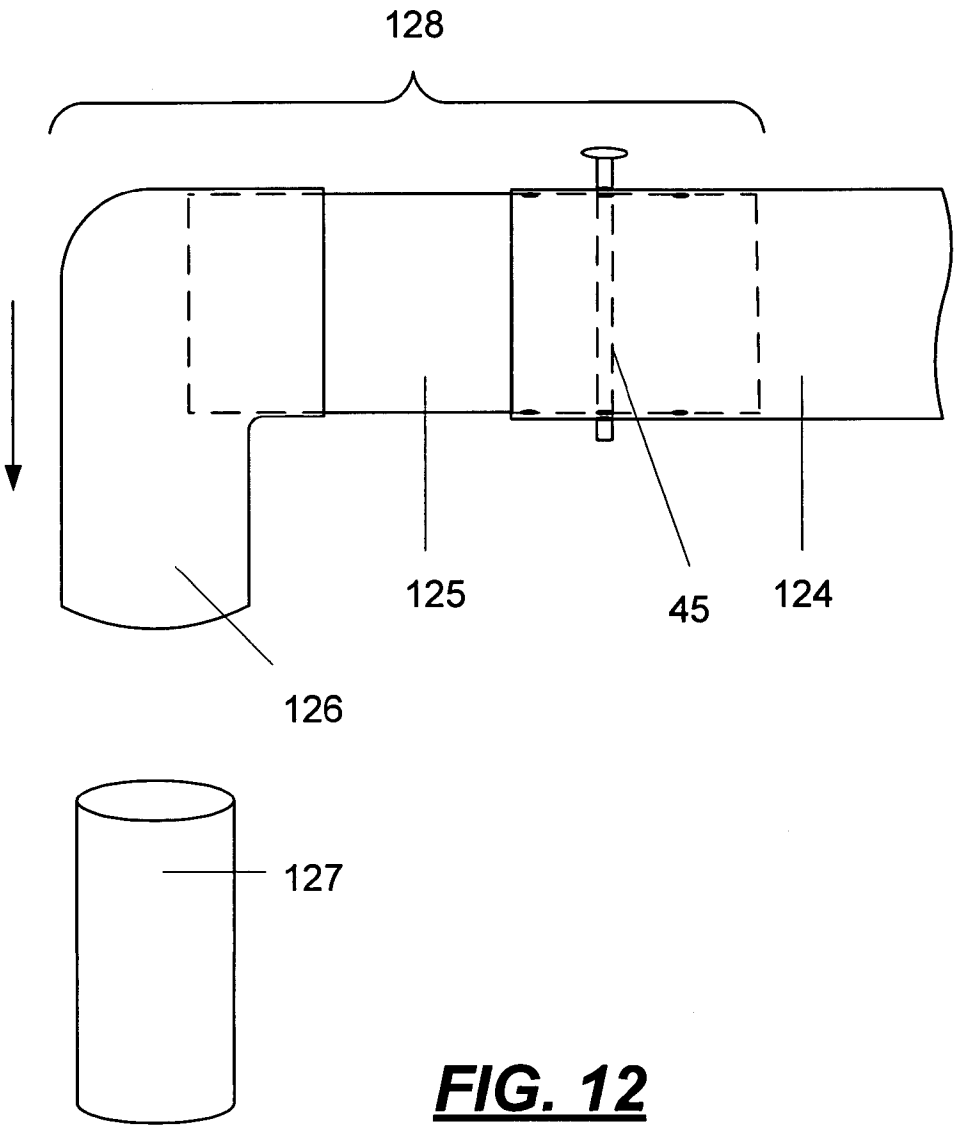
FIG. 12 is a schematic view of one adapter of the invention as its attaches to round fence stock.

FIG. 12 illustrates alternative means for attaching the first and second ends to fence stock other than notches. In the embodiment depicted in FIG. 12, a first spacing unit 124 is comprised of means for locking 45 and means for attaching to fence stock 128. In the embodiment depicted, means for attaching to fence stock 128 is comprised of connector 125 and adaptor 126. Connector 125 and adaptor 126 are configured such that adaptor 126 may be interchanged with a different adaptor, and thus permit attachment to different stock. In the embodiment depicted, adaptor 126 is configured to be placed atop round fence stock 127. As shown in FIG. 12, the adaptor 126 is larger than fence stock 127 and thus fits over stock 127. Alternative adaptor configurations are also within the scope of this invention.

As would be apparent to one skilled in the art, the use of adaptors alters the spacing between the two ends of the device. For example, if connector 125 is used, one must accommodate for the size of connector 125. This may be accomplished by placing pin 45 through a different hole. In one embodiment, a first hole is specially designated for use with the adaptor while a second hole is marked for use without the adaptor. For example, if the user wished to expand the device to a distance of four feet, the user would know to use either hole "4" (if no adaptor is being used) or hole "4A" (if an adaptor was being used). In this manner, the user may adjust for the length of the adaptor itself.

Figure 13B:
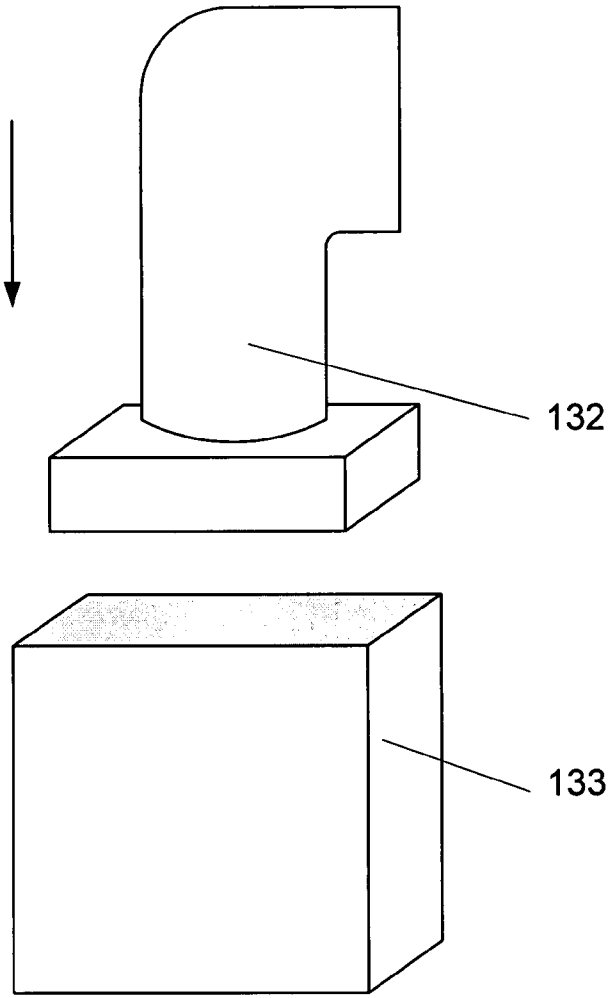
FIGS. 13A and 13B are perspective views of two adapters of the present invention.
Figure 13A:
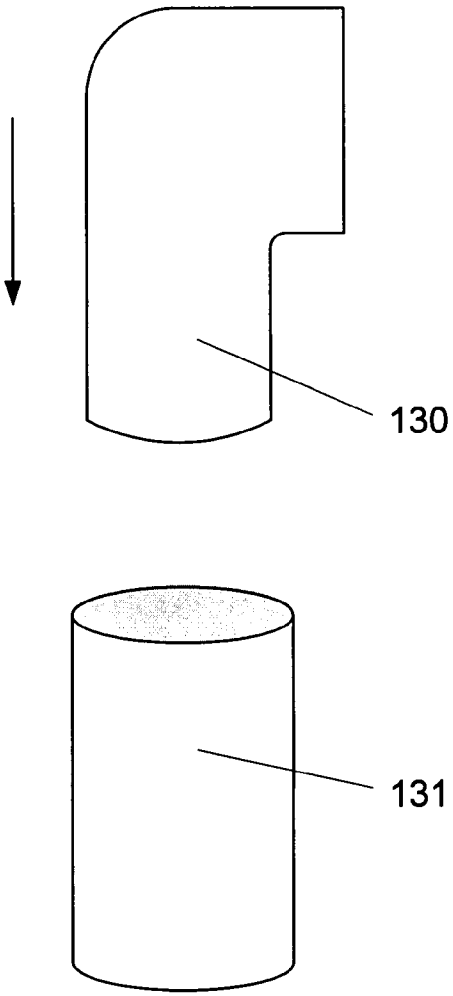

In the embodiments depicted in FIGS. 13A and 13B, two such alternative adaptor configurations are shown. In FIG. 13A, adaptor 130 is smaller than fence stock 131 and thus fits within stock 131. In FIG. 13B, adaptor 132 is configured to fit within square fence stock 133. It is clear than a multitude of adaptor configurations would likewise be apparent to those skilled in the art.

Figure 14:
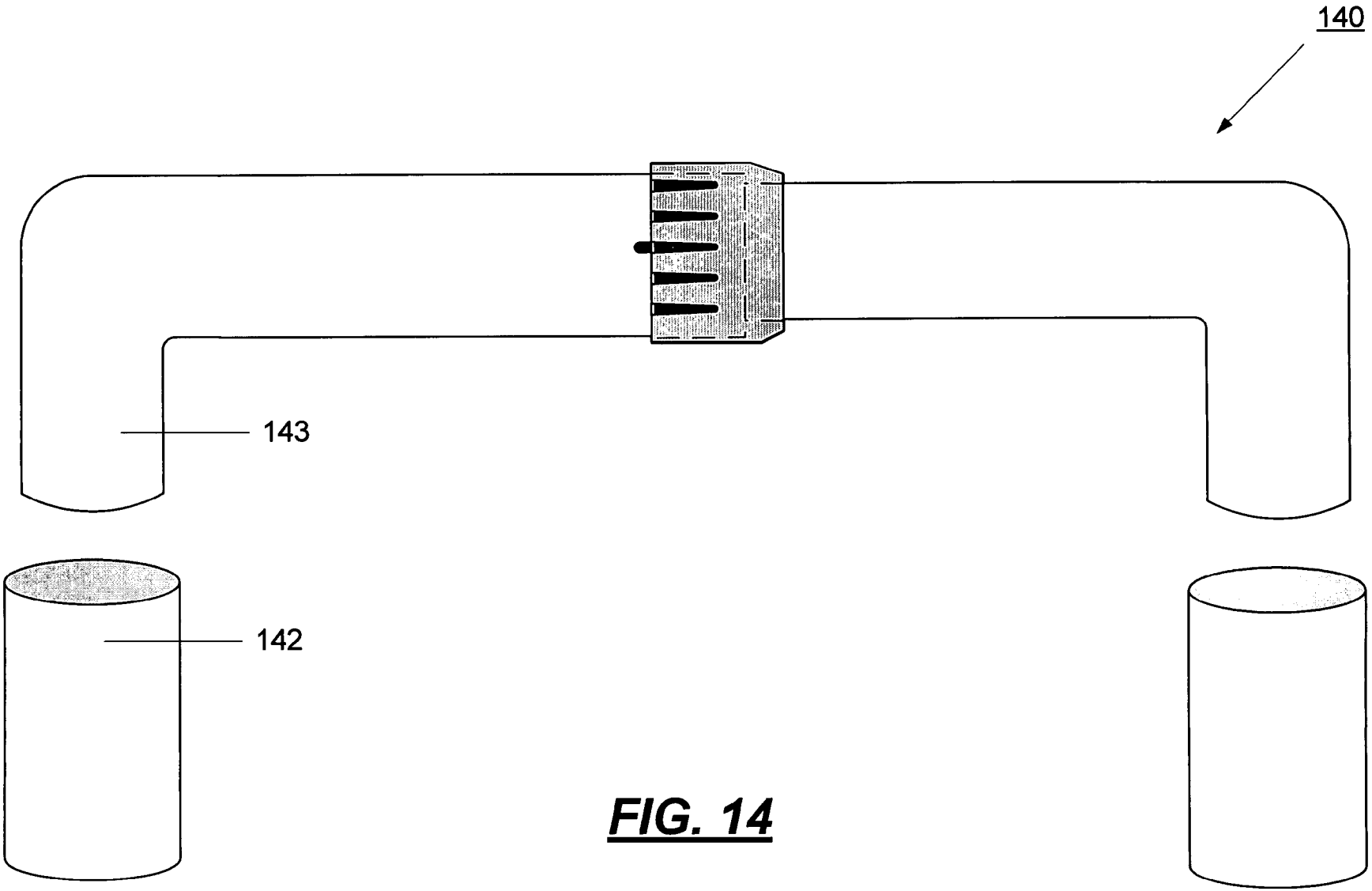
FIG. 14 is a perspective view of another means for attaching the present invention to fence stock.

In yet another embodiment, illustrated in FIG. 14, a spacing unit 140 is comprised of means for attaching 143 the spacing unit to the fence stock 142. In the embodiment depicted, means for attaching 143 is not interchangeable.

Figure 15:
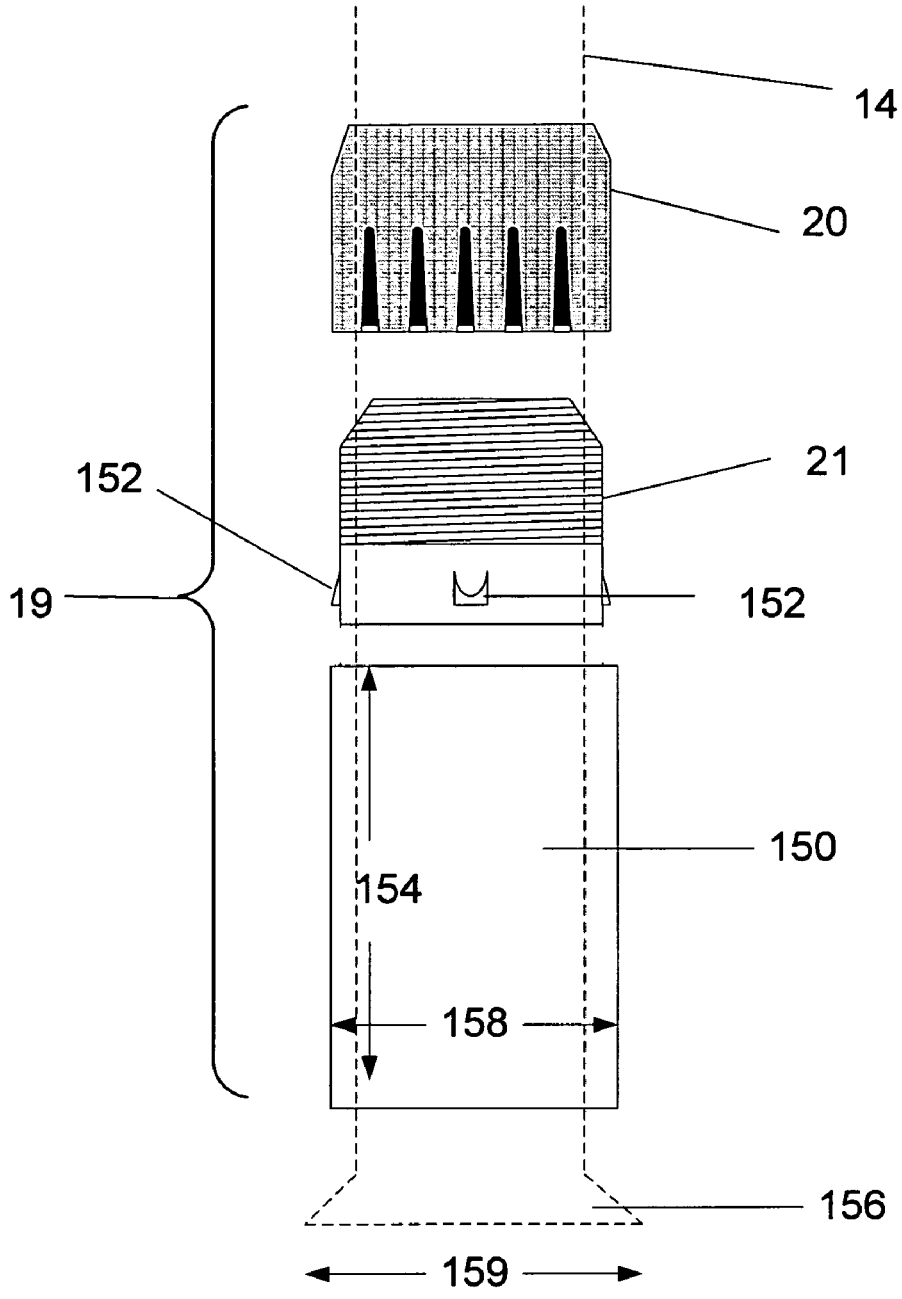
FIG. 15 is schematic view of one twist-grip lock for use with the present invention.

FIG. 15 is an illustration of means for locking 18 wherein the means for locking is twist-grip lock 19 which is adapted to be disposed about second spacing unit 14. Twist-grip lock 19 is comprised of female end 20, male end 21, locking tabs 152, and optionally, sleeve 150. In the embodiment depicted, second spacing unit 14 has a flared end 156 with a flared diameter 159. Sleeve 150 has a length 154 and a diameter 158. In the embodiment depicted flared diameter 159 is greater than diameter 158. Is it clear from FIG. 15 that this configuration prevents spacing unit 14 from being removed from the apparatus. Length 154 may vary. When sleeve 150 is used, the length 154 of sleeve 150 may be configured to ensure that the first spacing unit 12 and second spacing unit 14 remain firmly attached one another. In one embodiment, length 154 is one and five eighths inches.

As illustrated in FIG. 15, twist-grip lock 19 is comprised of locking tabs 152. Is it clear from FIG. 15 that when female end 20 and screwed onto male end 21, locking tabs 152 will become depressed and clamp down on second spacing unit 14, thus preventing its axial movement.

Figure 16B:
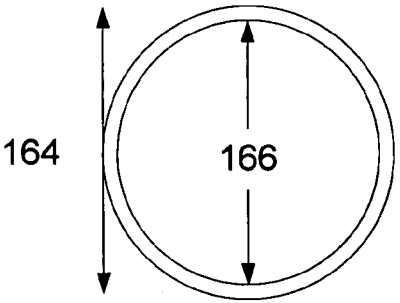
FIGS. 16, 16A, and 16B are illustrations of the ends of the first and second spacing units and their respective diameters.
Figure 16A:
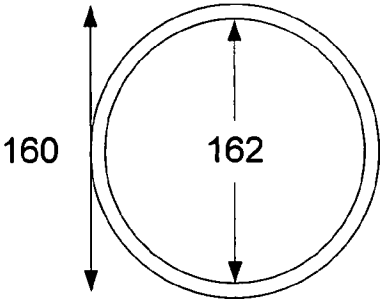
Figure 16:
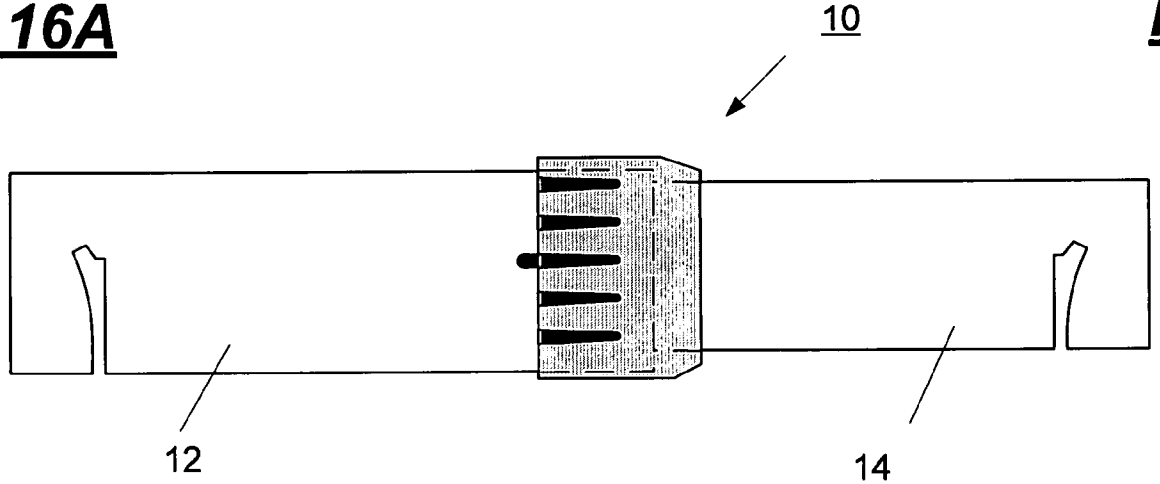

FIG. 16 is a side view of apparatus 10 which is substantially similar to the apparatus depicted in FIG. 1. In the embodiment depicted in FIG. 16, first spacing unit 12 and second spacing unit 14 are comprised of hollow tubes. FIGS. 16A and 16B are end views of first spacing unit 12 and second spacing unit 14 respectively.

FIG. 16A depicts the outer diameter 160 and the inner diameter 162 of first spacing unit 12. FIG. 16B depicted the outer diameter 164 and inner diameter 166 of second spacing unit 14. In one embodiment, outer diameter 160 is approximately one and one half inches, while inner diameter 162 is approximately one and seven sixteenth inches. In such an embodiment, outer diameter 164 is approximately one and one fourth inches, while inner diameter 166 is approximately one and three sixteenth inches.

Figure 17:
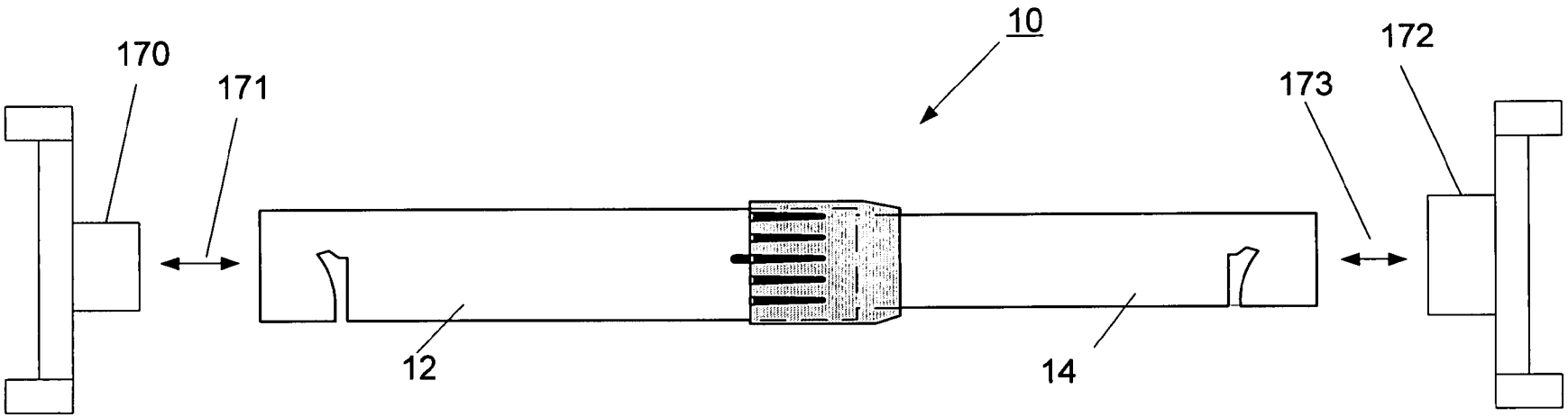
FIG. 17 depicts forked adaptors for use with the current invention.

FIG. 17 is a depiction of device 10 which is configured to receive first forked adaptor 170 and second forked adaptor 172. Such forked adaptors are operatively configured to be attached to square fence stock. Adaptors such as 170 and 172 are useful when spacing fence stock which are to be used for fence sections, as opposed to fence stock which are to be used for gate construction. In the embodiment depicted in FIG. 17, first forked adaptor 170 is configured to be attached to first spacing unit 12 by simply moving the adaptor in the direction of arrow 171. Similarly, second forked adaptor 172 is configured to be attached to second spacing unit 14 by moving the adaptor in the direction of arrow 173. In one embodiment, the attachment of adaptors such as 172 is reversible. Such adaptors may be held to device 10 by locking means. By way of illustration, and not limitation, one may use a pin-lock, as previously discussed. In another embodiment, the attachment of adaptors such as 172 is irreversible. For example, one may attach the adaptors by welding.

Figure 18:
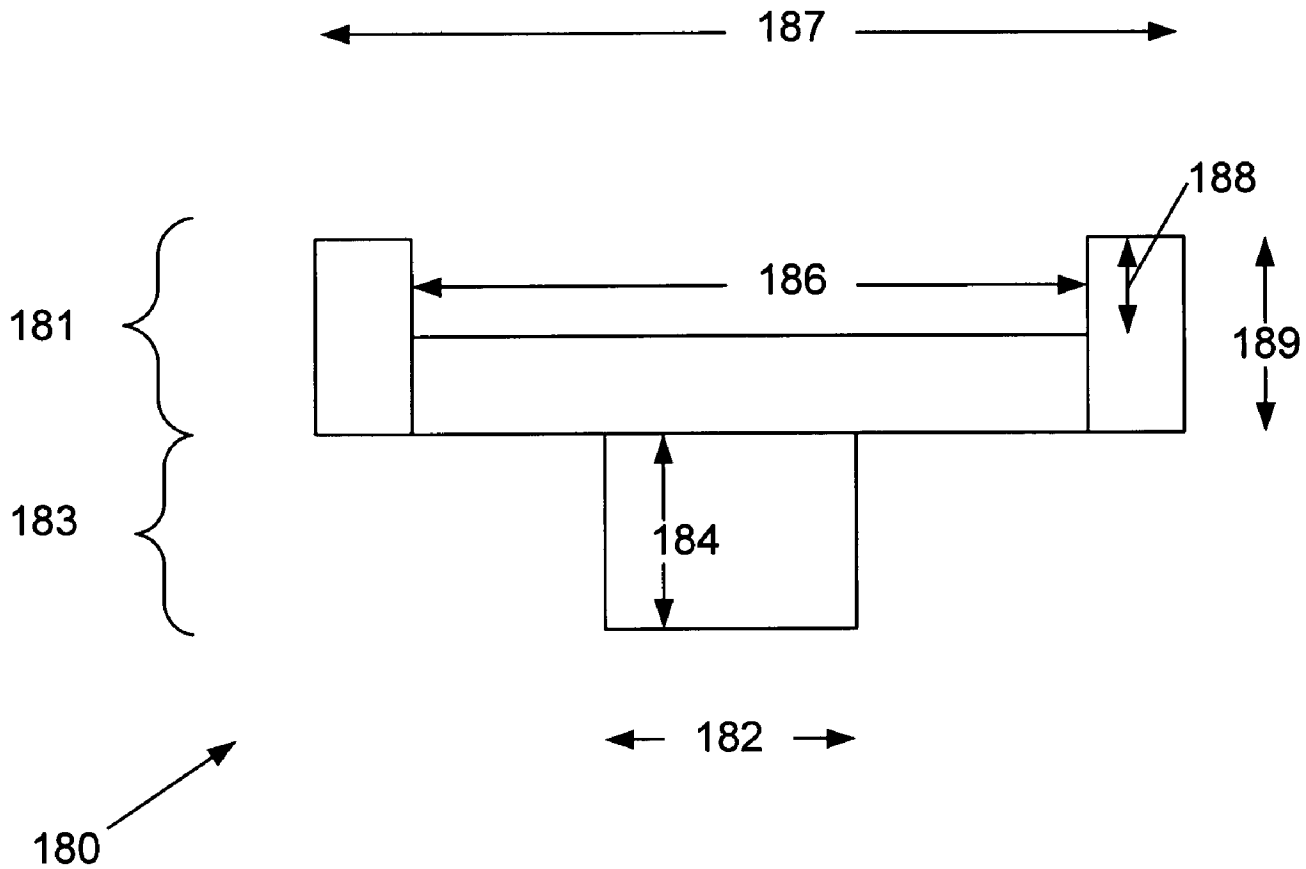
FIG. 18 is a schematic illustration of one forked adaptor.

FIG. 18 is a depiction of forked adaptor 180. As illustrated in FIG. 18, forked adaptor 180 has a fence mated end 181 and a device mated end 183. Fence mated end 181 has an inner width 186, an outer width 187, inner depth 188, and outer depth 189. In one embodiment, inner width 186 is six inches, outer width 187 is eight inches, inner depth 188 is one inch, and outer depth 189 is two inches. Device mated end 183 has a width 182 and a depth 184. In one embodiment, depth 184 is approximately two inches. The width 182 is configured such that it may be disposed onto the spacing unit of choice. For example, if device mated end 183 is to be disposed within a spacing unit with an inner diameter of one and seven sixteenth inches then width 182 may be one and one fourth inches. Such a fitting is illustrated in FIG. 17 with the union of forked adaptor 170 and first spacing unit 12. If device mated end 183 is to be disposed around a spacing unit with an outer diameter of one and one fourth inches, then width 182 may be one and one half inches. Such a fitting is illustrated in FIG. 17 with the union of forked adaptor 172 and second spacing unit 14.

Figure 19:
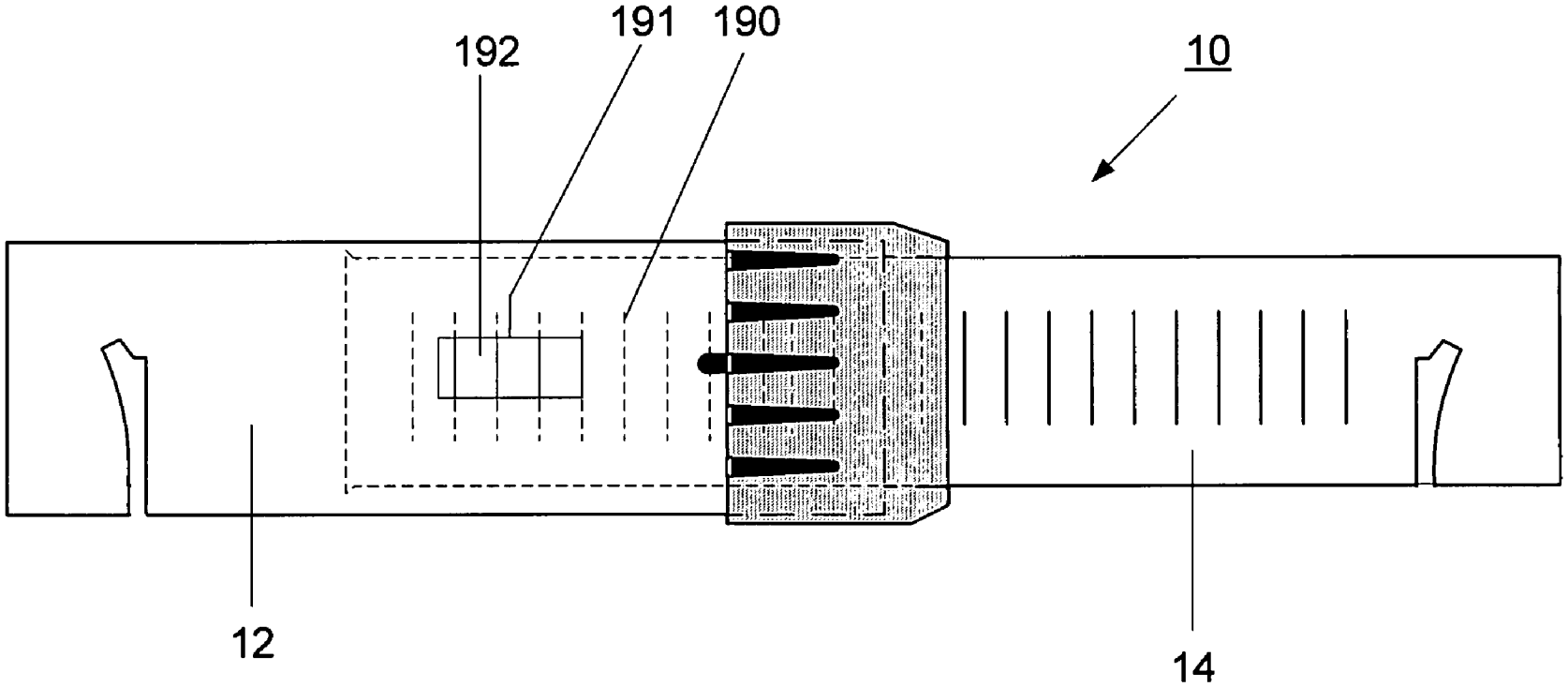
FIG. 19 is a schematic depiction of a measurement system for use with one embodiment of the invention.

In the embodiment depicted in FIG. 19, a measurement window 192 is used to accurately control the distance the device 10 has been expanded to. In the embodiment depicted in FIG. 19, second spacing unit 14 is comprised of a plurality of regularly spaced gradations 190. In one embodiment, these gradations are marked with an identifier. For example, the gradations may be marked to measure inches. First spacing unit 12 is comprised of a measuring mark 191. To accurately control the distance of expansion, the user simply aligns the selected gradation 190 with measuring mark 191 and then locks the spacing units such that axial movement is no longer possible.

Figures 20A, 20B, 20C:
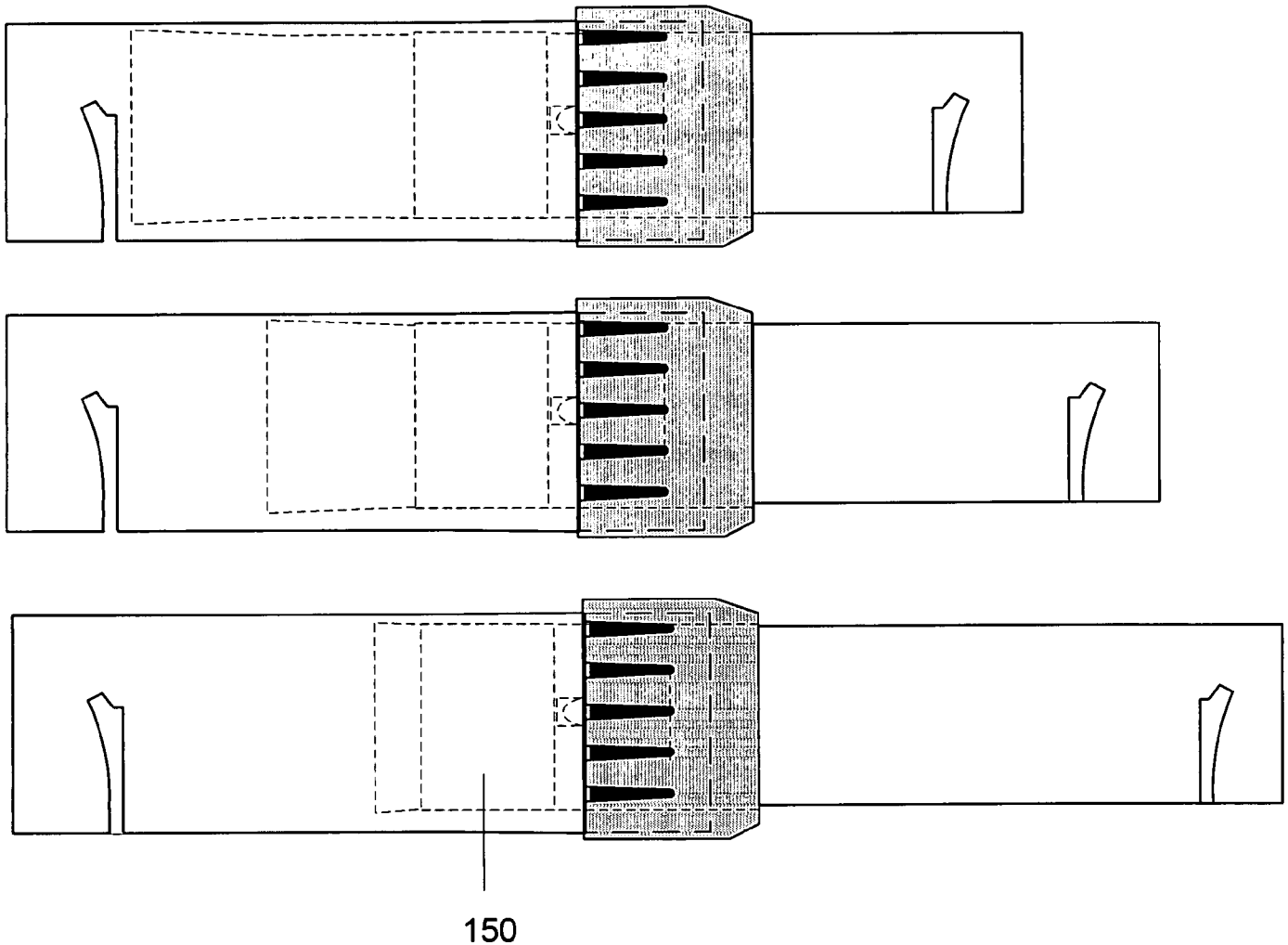
FIGS. 20A, 20B and 20C are illustrations of one embodiment of the invention in three stages of expansion.

FIGS. 20A, 20B and 20C are depictions of the device in various stages of expansion. FIG. 20A depicts the device in a totally collapsed state. FIG. 20B illustrates the device in a partially expanded state. FIG. 20C shows the device in a fully expanded state. It is clear from FIG. 20C that sleeve 150 prevents the device from expanding further. In another embodiment of the device, the length of sleeve 150 is altered so as to customize the expandability of the device. In another embodiment of the device, no sleeve is used.

As would be apparent to one skilled in the art, the spacing units and components thereof may be constructed from a variety of materials. In one embodiment, a plastic is used. In one such embodiment, PVC (polyvinylchloride) piping is used. In another embodiment, the spacing units are constructed from wood. In yet another embodiment, the spacing units are constructed from metal, such as stainless steel. In another embodiment, a device, such as a level, is attached, to the apparatus. Such a level is useful for alignment of the device parallel to the earth's surface.

It is therefore, apparent that there has been provided, in accordance with the present invention, a method and apparatus to assist in the construction of a gate opening. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for constructing a gate opening comprised of a. a spacing unit with a first end and a second end;

b. means for expanding said spacing unit such that the distance between said first end and said second end may vary;

c. means for locking said spacing unit such that the distance between said first end and said second end remains constant;

d. said first end is comprised of a first notch for attaching said first end to fence stock; and e. said second end is comprised of a second notch for attaching said second end to fence stock; wherein said first notch and said second notch each has a straight edge and a curved edge, wherein the straight edge is opposite the curved edge.

2. The apparatus for constructing a gate opening as recited in claim 1, wherein said first notch and said second notch are operatively configured to receive round fencing stock.

3. The apparatus for constructing a gate opening as recited in claim 1, wherein:

a. said first end is further comprised of a third notch operatively configured to receive square fencing stock; and b. said second end is further comprised of a fourth notch operatively configured to receive square fencing stock.

4. The apparatus for constructing a gate opening as recited in claim 1, wherein:

a. said first end is further comprised of a third notch operatively configured to receive round fencing stock; and b. said second end is further comprised of a fourth notch operatively configured to receive round fencing stock.

5. The apparatus for constructing a gate opening as recited in claim 1, further comprising an adaptor.

6. The apparatus for construing a gate opening as recited in claim 1, wherein said first notch and said second notch each have a depth approximately half of the thickness of said spacing unit.

7. An apparatus for constructing a gate opening comprised of a. a spacing unit with a first end and a second end;

b. means for expanding said spacing unit such that the distance between said first end and said second end may vary;

c. means for locking said spacing unit such that the distance between said first end and said second end remains constant;

d. said first end is comprised of a first notch operatively configured to receive square fence stock;

e. said second end is comprised of a second notch operatively configured to square receive fence stock; and wherein:

f. said first end is further comprised of a third notch operatively configured to receive round fencing stock; and g. said second end is further comprised of a fourth notch operatively configured to receive round fencing stock.

8. The apparatus for constructing a gate opening as recited in claim 1, wherein said first notch and said second notch are each operatively configured to receive both round and square fencing stock.

9. The apparatus for constructing a gate opening as recited in claim 8, wherein:

a. said spacing unit is comprised of a first spacing unit and a second spacing unit;

b. said first spacing unit is comprised of said first end and said second spacing unit is comprised of said second end;

c. said first spacing unit and said second spacing unit are axially arranged such that said first end and said second end are distal to each other; and d. said means for expanding said spacing unit is comprised of means for sliding said second spacing unit within said first spacing unit, thus varying the distance between said first end and said second end.

10. The apparatus for constructing a gate opening as recited in claim 9, wherein said means for locking consists of a twist-grip lock.

11. The apparatus for coring a gate opening as recited in claim 9, wherein said means for locking consists of a pin-lock.

12. The apparatus for constructing a gate opening as recited in claim 8, wherein:

a. said spacing unit is comprised of a first spacing unit, a second spacing unit, and a third spacing unit;

b. said first spacing unit is comprised of said first end and said second spacing unit is comprised of said second end;

c. said first spacing unit and said second spacing unit are axially arranged such that said first end and said second end are distal to each other;

d. said third spacing unit is disposed between said first spacing unit and said second spacing unit; and e. said means for expanding said spacing unit is comprised means for sliding said first spacing unit and said second spacing unit within said third spacing unit, thus varying the distance between said first end and said second end.

13. The apparatus for constructing a gate opening as recited in claim 12, wherein said means for locking consists of a pin-lock.

14. An apparatus for constructing a gate opening comprised of a. a first spacing unit with a first end;

i. said first end is comprised of a first dual-purpose notch with a first straight edge and a first curved edge opposite said first straight edge;

b. a second spacing unit with a second end;

i. said second end is comprised of a second dual-purpose notch with a second straight edge and a second curved edge opposite said second straight edge;

ii. said second spacing unit is disposed within said first spacing unit such that said second spacing unit may side axially within said first spacing unit;

c. said first dual-purpose notch and said second dual-purpose notch are operatively configured to attach to both square fencing stock and round fencing stock;

d. a lock for locking said first spacing unit and said second spacing unit in position such that axial movement of said first spacing unit and said second spacing unit is possible when said lock is not engaged, and axial movement is not possible when said lock is engaged.

15. The apparatus for constructing a gate opening as recited in claim 14, wherein said lock is a twist-grip lock.

16. The apparatus for constructing a gate opening as recited in claim 15, further comprising means for measuring the distance between said first duel purpose notch and said second duel-purpose notch.

17. The apparatus for constructing a gate opening as recited in claim 14, wherein said lock is a pin-lock.

18. The apparatus for constructing a gate opening as recited in claim 14, wherein:

a. said first dual-purpose notch is disposed approximately one inch from said first end, and b. said second dual-purpose notch is disposed approximately one inch from said second end.

19. An apparatus for constructing a gate opening consisting of a. a spacing unit with a first end and a second end;

b. means for expanding said spacing unit such that the distance between said first end and said second end may vary from about three feet to about five feet and four inches;

c. means for locking said spacing unit such that the distance between said first end and said second end remains constant;

d. said first end is comprised of a first dual-purpose notch with a first straight edge and a first curved edge opposite said first straight edge, for connecting said first end to fence stock; and e. said second end is comprised of a second dual-purpose notch with a second straight edge and a second curved edge opposite said first straight edge, for connecting said second end to fence stock.

* * * * *